United States Patent [19]

Cole

[11] Patent Number: 4,586,918

[45] Date of Patent: May 6, 1986

[54] CENTRIFUGE ROTOR HAVING A LOAD TRANSMITTING ARRANGEMENT

[75] Inventor: Paul M. Cole, Wilmington, Del.

[73] Assignee: E. I. Du Pont de Nemours and Company, Wilmington, Del.

[21] Appl. No.: 656,646

[22] Filed: Oct. 1, 1984

[51] Int. Cl.[4] ..... B04B 5/02

[52] U.S. Cl. ..... 494/20; 494/81

[58] Field of Search ..... 494/16, 20, 18, 17, 494/81, 43, 85; 422/72

[56] References Cited

U.S. PATENT DOCUMENTS 3,350,002 10/1967 Pickels .
4,093,118 6/1978 Sinn et al. .
4,120,450 10/1978 Whitehead .
4,427,406 1/1984 Nielsen .

FOREIGN PATENT DOCUMENTS 1782602 3/1982 Fed. Rep. of Germany .
505446 5/1939 United Kingdom .

*Primary Examiner*—Robert W. Jenkins

[57] ABSTRACT

A centrifuge rotor is characterized by the provision of a force transmitting arrangement operably associated with a sample container or a sample container support housing assembly for transmitting centrifugal force imposed on the sample container to a stress confining enclosure at locations other than the location at which the enclosure is directly loaded.

19 Claims, 7 Drawing Figures

CENTRIFUGE ROTOR HAVING A LOAD TRANSMITTING ARRANGEMENT

FIELD OF THE INVENTION

This invention relates to a centrifuge rotor having a load transmitting arrangement thereon for transmitting centrifugal force imposed on a sample carrying container into a stress confining band surrounding the rotor.

CROSS-REFERENCE TO RELATED APPLICATIONS

Subject matter disclosed herein is disclosed in the following copending applications:

Top Loading Swinging Bucket Centrifuge Rotor Having Knife Edge Pivots, Ser. No. 656,645, filed Oct. 1, 1984; and Sample Container For A Top Loading Swinging Bucket Centrifuge Rotor, Ser. No. 656,644, filed Oct. 1, 1984.

DESCRIPTION OF THE PRIOR ART

A centrifuge rotor of the type in which a sample container carrying a sample of the material to be centrifuged moves from an initial position in which the axis of the sample container is substantially parallel to the vertical center line of the rotor to a second position in which the axis of the sample container lies substantially in a plane perpendicular to the vertical center line of the rotor is known as a swinging bucket rotor. The rotor is typically surrounded by an enclosure, known as a windshield, which moves with the rotor and encloses the volume in which the sample containers occupy.

In a few prior centrifuges the interior surface of the windshield of the centrifuge rotor may be contoured such that, in the second position, the radially outer surface of the sample container abuts against and is supported by the interior surface of the windshield. Exemplary of such an instrument is that shown in U.S. Pat. No. 4,120,450 (Whitehead), assigned to the assignee of the present invention.

To enhance the load carrying capabilities of the rotor windshield it is known in the art to wrap the exterior surface of the windshield with a load confining band of composite material. Such a rotor is manufactured and sold by W. Hereaus Christ GmbH. Such a rotor is believed similar at least in this aspect to the device disclosed in U.S. Pat. No. 4,093,450 (Sinn et al.). In this patent, a swinging sample carrier translates radially outwardly into a supported relationship with a stress confining band. Other prior art rotors are provided with carrier supports which resiliently deform to dispose the carrier into a supported relationship with the outer boundary of the rotor windshield. Examples of such rotors are disclosed in U.K. Pat. No. 505,446 (Fuchs) and German Pat. No. 1,782,602 (Stallman). It has been found, however, that in all such rotors the localized interaction of the sample containers with the rotor windshield or with the stress confining band imposes high stresses in discrete localized regions of these members. This is perceived as disadvantageous.

To remedy this condition it is known in the art, as exemplified by the above-identified Hereaus Christ rotor, to provide radially extended rails on the rotor intermediate the arms which support the sample containers for pivotal movement. Mounted on the rails are suitable segment or wedge shaped masses which respond to centrifugal force by displacing along the rails from a radially inner to a radially outer position. In the radially outer position the outer surface of the masses abut in a force transmitting relationship with the windshield and the band (if provided) to thereby make more uniformly load the windshield (and band). However, the use of such masses merely for their loading effect is believed disadvantageous in that it increases the operational requirements of the rotor without a concomitant increase in its payload capacity.

In view of the foregoing, therefore, it is believed advantageous to provide a rotor construction which uniformly loads the windshield and/or band, yet does so without the imposition of mass over and above that necessary to structurally support the components of the rotor.

SUMMARY OF THE INVENTION

The present invention relates to a force transmitting arrangement for a centrifuge rotor of either the swinging bucket or fixed angle (including vertical angle) type which more uniformly loads a stress confining enclosure disposed about the rotor. The stress confining enclosure may take the form of a metallic or composite windshield either with or without an annular band of composite material provided circumferentially therearound.

In a first aspect the rotor of the present invention is provided with a sample container support housing assembly adapted to support a sample container in a desired orientation during centrifuge operation. For example, for a swinging bucket rotor, the support housing assembly would provide an appropriate form of support for the pivotal motion of the sample container from a first position (in which the axis of the container is parallel to the rotor axis) to a second position (in which the axis of the container is perpendicular to the axis of the rotor). If a fixed angle rotor is being used the support housing assembly is adapted to receive and hold the sample container with its axis at a predetermined angle (including zero degrees) with respect to the rotor axis. The sample container support housing is positioned such that in operation it is radially adjacent to a predetermined localized region of the enclosure. In one case the container support housing assembly is dimensioned so that it is disposed in a force transmissive relationship with the localized region of the enclosure while in a second case (either by design or by machining inaccuracy) the radially outer end of the housing assembly is spaced radially inwardly of the localized region of the enclosure.

In accordance with the first aspect of the invention the force transmitting arrangement includes a pair of substantially wedge shaped members disposed in a circumferentially spaced relationship to define therebetween a region adapted to accommodate the sample container support housing assembly therein. Each wedge shaped member has an abutment land thereon which is adapted to engage a conforming circumferentially flared surface on the sample container support housing assembly. In either the first or second case discussed above the wedges cooperably interact with the housing assembly to transmit centrifugal force to the stress confining enclosure at locations spaced from the localized region to thereby more uniformly load the enclosure.

In a second aspect the invention relates primarily to a swinging bucket rotor in which the sample container is pivotally movable from a first position in which its axis is parallel to the axis of rotation to a second position in which its axis is perpendicular to the axis of rotation. In this aspect the force transmitting arrangement comprises a substantially W-shaped member wherein confronting surfaces on the inner legs of the W are spaced to define a pocket adapted to accommodate the sample container and support the same for pivotal movement. Suitable accommodations to support the container in a fixed angle position may be provided. The radially outer surface of the jointure of the inner legs of the W is radially adjacent to a localized region of the enclosure and may or may not, as discussed with the cases outlined above, abut in a force transmissive contact with the localized region of the enclosure. In either case, in operation centrifugal force imposed on the container is transmitted through the force transmitting arrangement to distribute the centrifugal load at a plurality of spaced locations on the enclosure to thereby uniformly load the enclosure.

BRIEF DESCRIPTION OF THE DRAWINGS

The invention will be more fully understood from the following detailed description thereof taken in connection with the accompanying drawings which form a part of this application and in which.

DETAILED DESCRIPTION OF THE INVENTION

Figure 6:
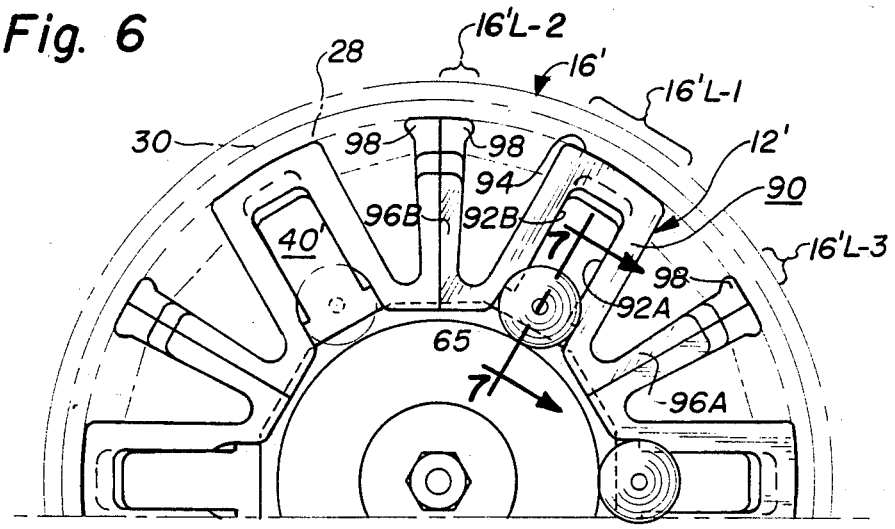
FIG. 6 is a plan view of a force transmitting arrangement in accordance with the second aspect of the present invention.

Throughout the following detailed description similar reference characters refer to similar elements in all figures of the drawings.

Figure 1:
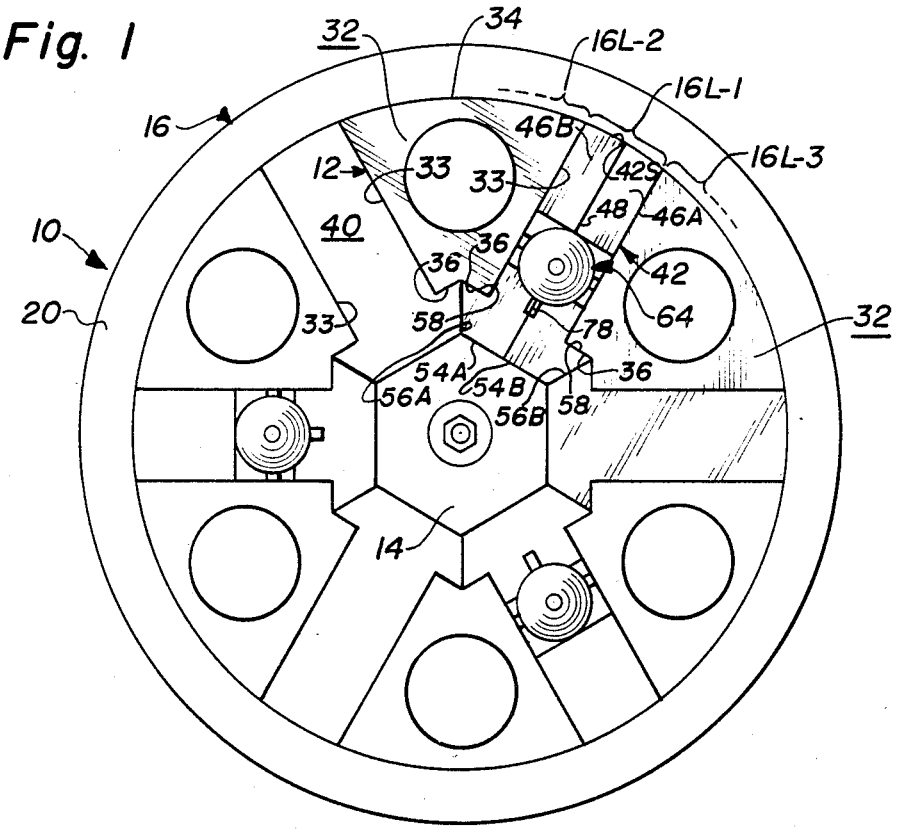
FIG. 1 is a plan view of a centrifuge rotor having a force transmitting arrangement in accordance with the first aspect of the invention.

Shown in FIG. 1 is a plan view of a centrifuge rotor indicated by reference character 10 having a force transmitting arrangement generally indicated by reference character 12 in accordance with the first aspect of the present invention. The rotor 10 includes a central hub 14 connectable by any suitable means of attachment to a suitable source of motive energy. The rotor 10 includes any suitable stress confining enclosure generally indicated by reference character 16. As best seen in FIGS. 2 through 5, the stress confining enclosure preferably takes the form of a substantially ring or bowl-shaped receptacle 18 having an annular rim 20 that defines a substantially cylindrical surface 22 leading to a frustoconical region 24. The receptacle is connected to the hub 14 by any suitable means of attachment. Alternatively, as shown in FIG. 6, the enclosure 16' may include a metal or composite windshield 28 attached for rotation with the rotor. If desired the windshield 28 may be surrounded by a band or wrapping 30 typically formed of a composite fiber material such as an epoxy coated aramid fiber manufactured and sold by E. I. du Pont de Nemours and Co. Inc. under the trademark KEVLAR®. The assembly is wound, then placed in an autoclave. The temperature is elevated to a suitable level and held for predetermined time to cure the epoxy. The receptacle 18 may be fabricated from the same material in a similar manner.

In accordance with the present invention the force transmitting arrangement 12 includes a generally wedge-shaped member 32. The member 32 includes generally radially extending sidewalls 33 joined by an arcuate surface 34 configured and machined for close fitting receipt and abutment in a force transmissive relationship to the stress confining enclosure 16. The radially inner portion of the member 32 is provided with circumferentially extending abutment surfaces 36 for a purpose to be discussed.

Angularly adjacent ones of the members 32 cooperate to define radially extending pockets 40 extending between confronting sidewalls 33 of the members 32. A sample container support housing assembly generally indicated by reference character 42 is insertable into each of the pockets 40. The sample container support housing assembly 42 may take a variety of forms, depending upon whether the rotor is to be configured as a swinging bucket or fixed angle (including vertical tube) rotor.

Figure 2:
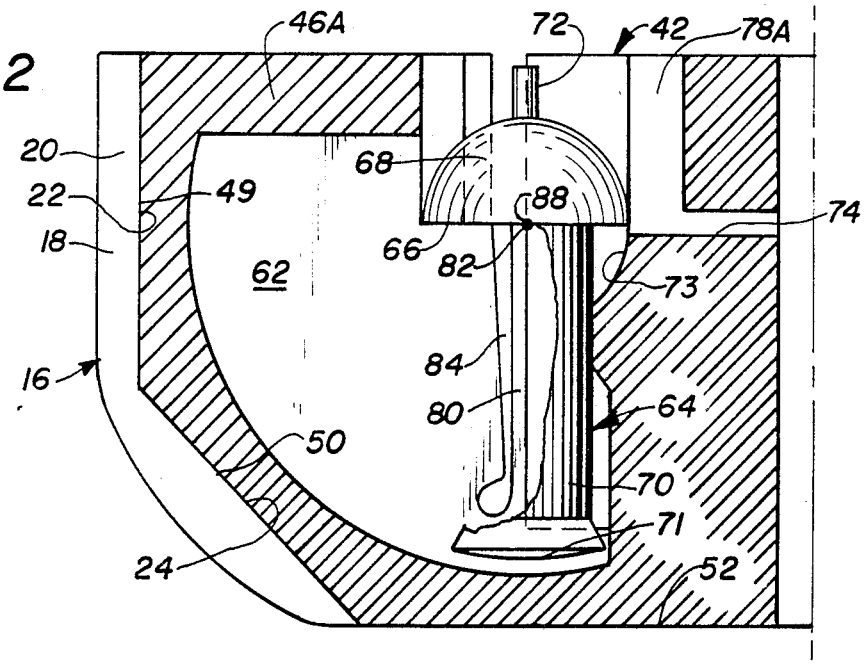
FIGS. 2 and 3 are respectively side sectional views of a sample container support housing assembly useful for a swinging bucket rotor application in a rotor in accordance with the first aspect of the present invention.
Figure 3:
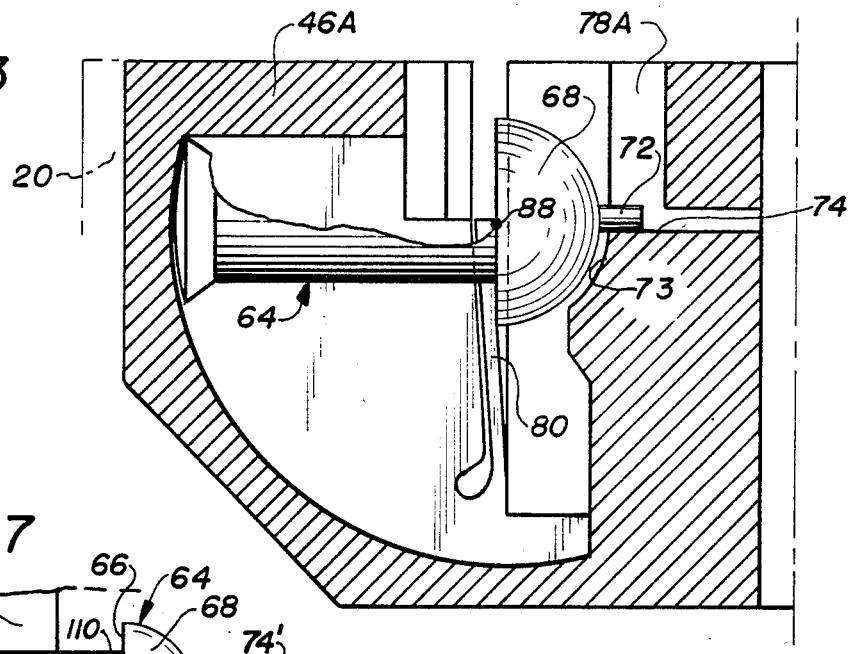

For example, as seen in FIGS. 2 and 3, if it is desired to configure the rotor 10 as a swinging bucket rotor, the sample container support housing assembly 42 preferably includes a pair of support housing members 46A and 46B which are mirror images of each other. The housing members 46A and 46B are joinable along a generally radially extending jointure plane 48. The exterior surface of the housing members 46 is configured for close fitting receipt within the receptacle 18. To this end the radially outer surface of each housing member 46A and 46B is substantially cylindrical, as shown at 49. A frustoconical surface 50 is connected to the portion 49. The radially inner surface of each housing member 46A and 46B is flattened, as at 54A and 54B, for adjoining contact with the hub 14. The radially inner surface may take any other suitable form, in which case the shape of the hub 14 is correspondingly shaped.

The housing members 46A and 46B, when cojoined define the sample container support housing assembly 42 the radially outer surface 42S of which is radially adjacent to a predetermined localized region 16L-1 of the enclosure 16. By predesign or due to machining tolerances or inaccuracies the surface 42S of the housing assembly 42 may or may not contact the localized region 16L-1 but instead lie a distance radially inwardly thereof. Both cases are to be construed as lying within the scope of the present invention.

Provided near the radially inward end of each of the housing elements 46 is a tab 56 having a vertically planar circumferentially flaring land or surface 58 sized for receipt in an abutting relationship with the abutment surface 36 on the wedge-shaped member 34 with which it is adjacent.

Each housing element 46A and 46B is recessed, as at 62, on its interior to define a volume in which the pivotal movement of a sample container 64 may occur. Any suitable sample container 64 may be used, and the housing elements 46A and 46B are appropriately modified to provide the appropriate trunnions to accommodate the pivotal motion of the container. Preferably, the sample container 64 takes the form of that disclosed and claimed in the second of the cross-referenced copending applications. Such a container 64 is provided with a planar annular undersurface 66 on a cap 68 that is joinable to a tubular body member 70 having a spherical lower end 71. The sample to be centrifuged is received in the tubular body 70. A rotation restraining pin 72 is disposed atop the cap 68.

To accommodate the sample container 64 a pivot arrangement described in full detail in the first of the cross-referenced copending applications may be used. Briefly described, the housing elements 46 each include a spherical surface 73 which communicates with a rotation arresting surface 74. A vertical guide surface 78A, 78B communicates with the surface 74. When the confronting housing elements 46A and 46B are joined the surfaces 78A and 78B cooperate to form a slot 78 which, with the pin 72, guides the motion of the sample container over a portion of its travel from a first position (in which the axis of the container 64 is parallel to the axis of rotation of the rotor 10) to a second position (in which the axis of the container 64 is perpendicular to the axis of rotation) and to arrest the pivotal motion when the container 64 is oriented in the second position.

Cantilevered from a surface of each of the housing elements 46 is a resilient leg 80 which has at its upper end a knife-like pivot support edge 82. The leg 80 is radially spaced by a distance 84 from the main body portion of the housing element 46. As the rotor 10 is rotated the container 64 pivots along a line contact 88 defined between the pivot edge 82 and the surface 66 from the first to the second position. The leg 80 is designed to resist appreciable radial deflection as the container 64 pivots to the second position. Once in the second position continued rotation of the rotor causes the spring legs 80 to flex radially outwardly to close the space 84 and to bring the bottom surface of the container 64 into force transmissive contact with the housing assembly 42. If the surface 42S of the container assembly 42 is in abutment with the region 16L-1 the container 64 is placed, through the assembly 42, into a force transmissive relationship with the localized region 16L-1 of the enclosure 16.

Figure 4:
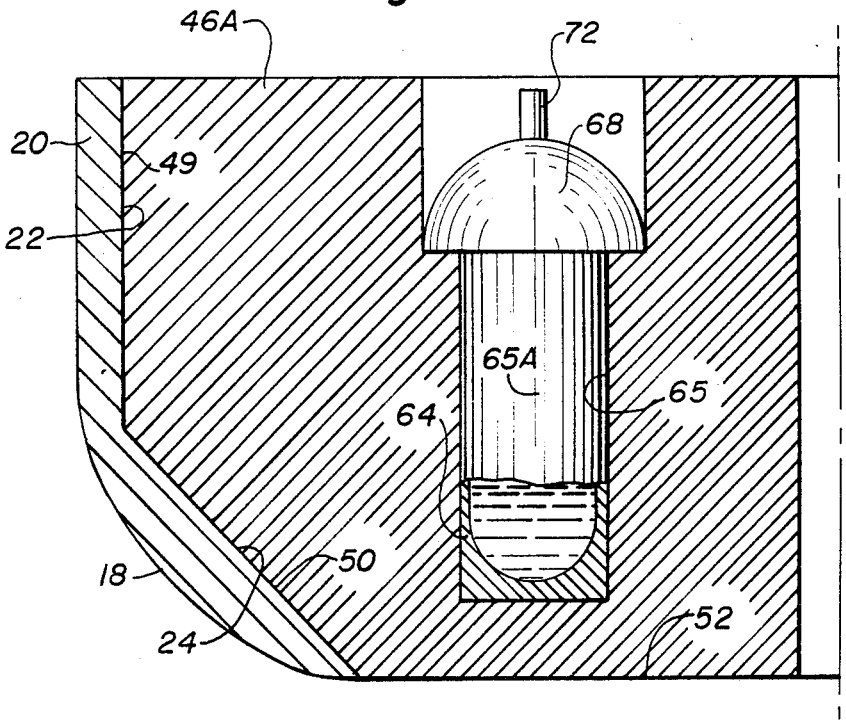
FIGS. 4 and 5 are views similar to FIGS. 2 and 3 respectively showing a sample container support housing assembly useful for a vertical tube and a fixed angle rotor application in accordance with the first aspect of the invention.
Figure 5:
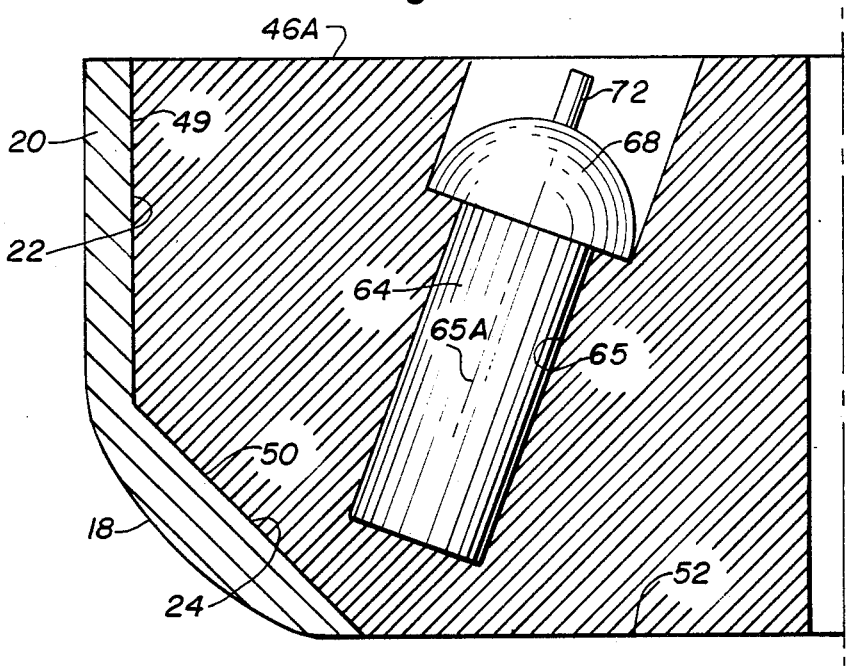

As noted, if it is desired to configure the rotor 10 as a fixed angle rotor the recess in the sample container support housing assembly 42 may be configured to define a fixed angle recess. As shown in FIG. 5 the axis 65A of the recess 65 may be inclined to the spin axis or, as seen in FIG. 4, may be parallel thereto.

It is again noted that whether the support housing assembly 42 is configured to provide a swinging bucket rotor or fixed angle rotor (including the vertical tube case) the exterior of the sample container support housing assembly 42 is provided with the circumferentially extending tabs 56 having the vertically planar abutment lands 58 thereon. The lands 58 engage the abutment surfaces 36 on the members 32. It is, of course, appreciated that the sample container support housing assembly 42 used in any of the embodiments shown in FIGS. 1 through 5 may be fabricated as an integral member having an appropriately oriented recess and/or appropriate pivot supports provided in communication therewith.

In operation, as the rotor 10 is spun, centrifugal force imposed on the sample container 64 and on the assembly 42 is transferred through the housing assembly 42 into the stress confining enclosure 16 (if the surface 42S abuts the enclosure 16) to load the localized region 16L-1 thereof. In accordance with this invention (whether or not the assembly 42 abuts the enclosure 16 or, whether the assembly 42 so abuts once a given rotor speed is reached), the force transmitting abutment between the sample container support housing assembly 42 and the segments 32 along the interface between the surfaces 36 and 58 respectively on housing assembly 42 and the members 32 serves to transmit centrifugal force imposed on the sample container 64 and on the support housing assembly 42 through the members 32 to regions 16L-2, 16L-3 of the stress confining enclosure 16 other than the localized region 16L-1 at which direct loading of the enclosure 16 by the housing assembly 42 and the container 64 occurs. In this way the stress confining enclosure 16 is more uniformly loaded. It is noted that since the segments 32 in FIG. 1 may interact with more than one assembly 42 the regions 16L-2 and 16L-3 are only generally indicated.

In another aspect of the invention as shown in FIG. 6 the force transmitting arrangement 12' takes the form of substantially W-shaped members 90. The confronting surfaces 92A, 92B of the inner legs 92 of the W-shaped member 90 cooperate to define the pocket 40' which receives the swinging bucket sample containers 64. Alternatively, the inner surfaces 92A, 92B of the legs 92 may be configured to support a sample containing housing assembly in a fixed angle (including a vertical angle) configuration. The radially outer surface 94 that defines the jointure of the inner legs 92 is radially adjacent to the region 16'L-1 of the enclosure 16' and may or may not, as discussed above, contact the enclosure 16'. If the surface 94 is arranged to contact (or if contact occurs at a given rotational speed) the surface 94 as well as the radially outer surfaces of the outer legs 96A, 96B of the W have a shape conforming to the inner surface of the enclosure 16'.

Figure 7:
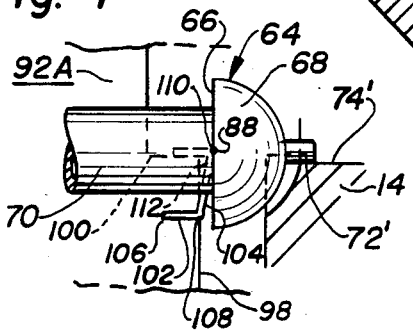
FIG. 7 is a detail view taken along lines 7—7 in FIG. 6 illustrating a mounting arrangement for a swinging bucket.

In the preferred swinging bucket case each of the surfaces 92A and 92B is provided with a form of knife-edge pivot elements such as shown in FIG. 7. A step 96 having a vertically planar face 98, a horizontal shelf 100 and a horizontal notch 102 is formed on each surface 92. A resilient strip 104 is inserted at one end 106 into the notch 102. The strip 104 is bent at 108 and inclines radially inwardly to a second bend 110. The strip 104 is thus bent rearwardly so that a portion overlaps the shelf 100. The underside of the strip 104 between the bends 108 and 110 is spaced a distance 112 from the vertical face 98. If the container 64 is used, the core 14 may be provided with a rotation arresting surface 74'. Alternatively, standard trunnion supports adapted to cooperate with standard trunnion pins provided on the sample container may be used.

In the fixed angle case suitable support structures adapted to hold a sample container in the desired angular orientation with respect to the axis of rotation are provided on the inner surfaces 92A, 92B of the inner legs 92 of the W.

In operation, in the fixed angle case, centrifugal force imposed on the sample container 64 is indirectly transmitted through the member 90 into the stress confining enclosure 16' when and if abutment between the surface 94 and the enclosure 16' occurs. Specifically the enclosure 16' may be loaded at the region 16'L-1. In any event the enclosure 16' is loaded by action of the legs 96 at the regions 16'L-2 and 16'L-3 spaced along the enclosure 16'. The enclosure 16' is thus more uniformly stressed.

In the swinging bucket case movement of the sample container 64 from the first to the second position on the knife edge line 110 is similar to that above-described in connection with FIGS. 2 and 3 and the knife edge pivot there shown. Thereafter, radial deflection of the pivot support 104 brings the lower surface 71 of the container 64 into abutting contact of the inner surface of the jointure 94 of the inner legs 92 of the W-shaped member. Similar to the fixed angle case the enclosure 16' may or may not be subjected to loading at the region 16' L-1 but due to the action of the legs 96 the enclosure 16' is loaded at a plurality of localized regions 16'L-2 and 16'L-3 spaced from the region 16'L-1.

Of course, as suggested in the FIG. 6, angularly extending arcuate portions 98 may be provided to partially or fully close the circumferentially open regions between the ends of the outer legs 96 of the W-shaped member and the jointure 94 of the inner legs 92 thereof.

In view of the foregoing, those skilled in the art having the benefit of the teachings of the present invention as set forth herein may effect numerous modifications thereto. These modifications are, however to be be construed as line within the scope of the present invention as set forth in the appended claims.

What is claimed is:

1. A centrifuge rotor for subjecting a sample carried in a sample container to a centrifugal force field, the rotor having a stress confining enclosure thereon, comprising:

a sample container support housing assembly for supporting the sample container within the rotor such that, in operation, the housing assembly is radially adjacent to a localized region of the enclosure; and, a force transmitting arrangement operably associated with the sample container support housing assembly for transmitting centrifugal force imposed on the container to the enclosure at locations spaced from the localized region thereby to more uniformly load the enclosure.

2. The centrifuge rotor of claim 1 wherein the sample container support housing assembly has a circumferentially flaring surface thereon and wherein the force transmitting arrangement comprises a member having an abutment surface adapted to abut the flaring surface on the sample container support housing assembly thereby to transmit centrifugal force imposed on the sample container through the transmitting arrangement to the enclosure.

3. The centrifuge rotor of claim 2 wherein the sample container support housing assembly is adapted to support the sample container in a fixed angle configuration.

4. The centrifuge rotor of claim 2 wherein the sample container support housing assembly is adapted to support the sample container such that the axis thereof remains parallel to the axis of rotation of the rotor.

5. The centrifuge rotor of claim 2 wherein the sample container support housing assembly is adapted to support the sample container for pivotal motion from a first position in which the axis of the container is substantially parallel to the axis of rotation of the rotor to a second position in which the axis of the container is substantially perpendicular to the axis of rotation of the rotor.

6. The centrifuge rotor of claim 1 wherein the sample container support housing has a pair of circumferentially flaring surfaces thereon and wherein the force transmitting arrangement comprises a pair of members circumferentially spaced about the rotor, each of the members having an abutment surface thereon, the members being disposed about the rotor and cooperable with each other to define a region adapted to receive the sample container support housing assembly therein so that each of the flaring surfaces on the housing assembly operatively abuts one of the abutment surfaces thereby to transmit centrifugal force imposed on the sample container through the transmitting arrangement to the enclosure.

7. The centrifuge rotor of claim 6 wherein the sample container support housing assembly is adapted to support the sample container in a fixed angle configuration.

8. The centrifuge rotor of claim 6 wherein the sample container support housing assembly is adapted to support the sample container such that the axis thereof remains parallel to the axis of rotation of the rotor.

9. The centrifuge rotor of claim 6 wherein the sample container support housing assembly is adapted to support the sample container for pivotal motion from a first position in which the axis of the container is substantially parallel to the axis of rotation of the rotor to a second position in which the axis of the container is substantially perpendicular to the axis of rotation of the rotor.

10. The centrifuge rotor of claim 1 wherein the sample container support housing assembly is adapted to support the sample container in a fixed angle configuration.

11. The centrifuge rotor of claim 1 wherein the sample container support housing assembly is adapted to support the sample container such that the axis thereof remains parallel to the axis of rotation of the rotor.

12. The centrifuge rotor of claim 1 wherein the sample container support housing assembly is adapted to support the sample container for pivotal motion from a first position in which the axis of the container is substantially parallel to the axis of rotation of the rotor to a second position in which the axis of the container is substantially perpendicular to the axis of rotation of the rotor.

13. The centrifuge rotor of claim 1 wherein the sample container support housing assembly, in operation, is disposed in a force transmissive relationship with the localized region of the enclosure.

14. The centrifuge rotor of claim 1 wherein the sample container support housing assembly, in operation, is spaced a radial distance inwardly of the localized region of the enclosure.

15. A centrifuge rotor for subjecting a sample carried in a sample container to a centrifugal force field, the rotor having a stress confining enclosure thereon, the sample container being movable under centrifugal force from an initial position in which the axis of the sample container is substantially parallel to the vertical center line of the rotor to a second position in which the axis of the container is substantially perpendicular to the vertical center line and wherein at a predetermined rotational speed the radially outer portion of the container is radially adjacent to a localized region of the enclosure, comprising:

a force transmitting arrangement operably associated with the sample container for indirectly transmitting centrifugal force imposed on the container to the enclosure at a plurality of spaced locations spaced from the localized region thereby to uniformly load the enclosure.

16. The centrifuge rotor of claim 15 wherein the force transmitting arrangement comprises a substantially W-shaped member with the confronting surfaces of the inner legs of the W being spaced so as to define a pocket adapted to accommodate the sample container therein.

17. The centrifuge rotor of claim 16 wherein the confronting inner surfaces of the legs of the W-shaped member are provided with a sample container pivot element thereon, the jointure of the inner legs of the W-shaped member being in a force transmissive relationship with the enclosure at a first localized region thereof, the radially outer surface of each of the two outer legs of the W-shaped member being shaped to conform to the shape of the inner surface of the enclosure at second and third local regions spaced from the first localized region thereby to transmit centrifugal force to the enclosure to uniformly load the same.

18. The centrifuge rotor of claim 16 wherein the confronting inner surfaces of the legs of the W-shaped member are provided with means to support a sample container in a fixed angle relationship with respect to the axis of rotation of the rotor, the jointure of the inner legs of the W-shaped member being in a force transmissive relationship with the enclosure at a first localized region thereof, the radially outer surface of each of the two outer legs of the W-shaped member being shaped to conform to the shape of the inner surface of the enclosure at second and third local regions spaced from the first localized region thereby to transmit centrifugal force to the enclosure to uniformly load the same.

19. The centrifuge rotor of claim 18 wherein the sample container is supported such that the axis thereof is parallel to the axis of rotation of the rotor.

* * * * *